US009414687B2

(12) United States Patent
Parton

(10) Patent No.: US 9,414,687 B2
(45) Date of Patent: Aug. 16, 2016

(54) COLLAPSIBLE SEAT AND STORAGE APPARATUS

(71) Applicant: Carl Furman Parton, Rutherfordton, NC (US)

(72) Inventor: Carl Furman Parton, Rutherfordton, NC (US)

( * ) Notice: Subject to any disclaimer, the term of this patent is extended or adjusted under 35 U.S.C. 154(b) by 0 days.

(21) Appl. No.: 13/815,752

(22) Filed: Jun. 17, 2013

(65) Prior Publication Data

US 2014/0368002 A1 Dec. 18, 2014

(51) Int. Cl.

| | |
|---|---|
| ***A47C 1/00*** | (2006.01) |
| ***A47C 4/00*** | (2006.01) |
| ***A47C 7/62*** | (2006.01) |
| ***A47C 9/10*** | (2006.01) |
| ***A47C 4/28*** | (2006.01) |
| *A45F 4/00* | (2006.01) |

(52) U.S. Cl.
CPC . *A47C 9/10* (2013.01); *A47C 4/286* (2013.01); *A45F 2004/006* (2013.01)

(58) Field of Classification Search
CPC ..... A47C 9/10; A47C 4/286; A47C 4/00; A45F 2004/006; A47D 1/02
USPC ..... 297/17, 16.2, 16.1, 60, 59, 53, 36, 4, 297/188.08, 188.18, 188.14; 224/161, 254
See application file for complete search history.

(56) References Cited

U.S. PATENT DOCUMENTS

| | | | | |
|---|---|---|---|---|
| 181,088 A * | 8/1876 | Matthiessen | ..... | 297/36 |
| 3,690,525 A * | 9/1972 | Koons et al. | ..... | 224/155 |
| 5,695,099 A * | 12/1997 | Strum | ..... | 224/155 |
| 7,775,587 B1 * | 8/2010 | Reed | ..... | 297/35 |

* cited by examiner

*Primary Examiner* — Milton Nelson, Jr.

(57) ABSTRACT

A collapsible seat and storage apparatus converts from a closed position to an open position. The apparatus includes a seat, a shelf, at least one leg, and carrying parts to allow a person to support the apparatus on his or her shoulders. In a partially open configuration, the apparatus provides a seat.

7 Claims, 5 Drawing Sheets

COLLAPSIBLE SEAT AND STORAGE APPARATUS

BACKGROUND OF THE INVENTION

The inventor is an amateur fisherman and recognized the difficulty of carrying fishing supplies from a home or parking space to a beach or other fishing location. He further recognized that once in a fishing location, the fisher needed a convenient way to organize and use these supplies.

SUMMARY OF THE INVENTION

The invention is a collapsible seat and storage apparatus that allows a person to easily transport supplies and provides seating. The apparatus comprises a back part with a first side and a second side wherein said first side and said second side are generally parallel to one another; a first side part movably coupled to said first side of said back part; a second side part movable coupled to said second side of said back part; a seat movably coupled to said back part; a shelf movably coupled to said back part wherein said shelf is positioned below said seat; at least one leg movably coupled to at least one of said back part, said first side part, said second side part, and said shelf; wherein said first side part, said second side part, said seat, said shelf and said at least one leg move independently from an open position to a closed position.

DETAILED DESCRIPTION

This detailed description describes one embodiment of the invention. It should be recognized that there are alternative configurations that are encompassed by the claimed invention. In particular, although this apparatus was originally designed for recreational activity, it is equally useful for work and other activities. The apparatus is collapsible from its fully open position, shown in FIG. 1, to a closed position, shown in FIG. 2.

Figure 1:
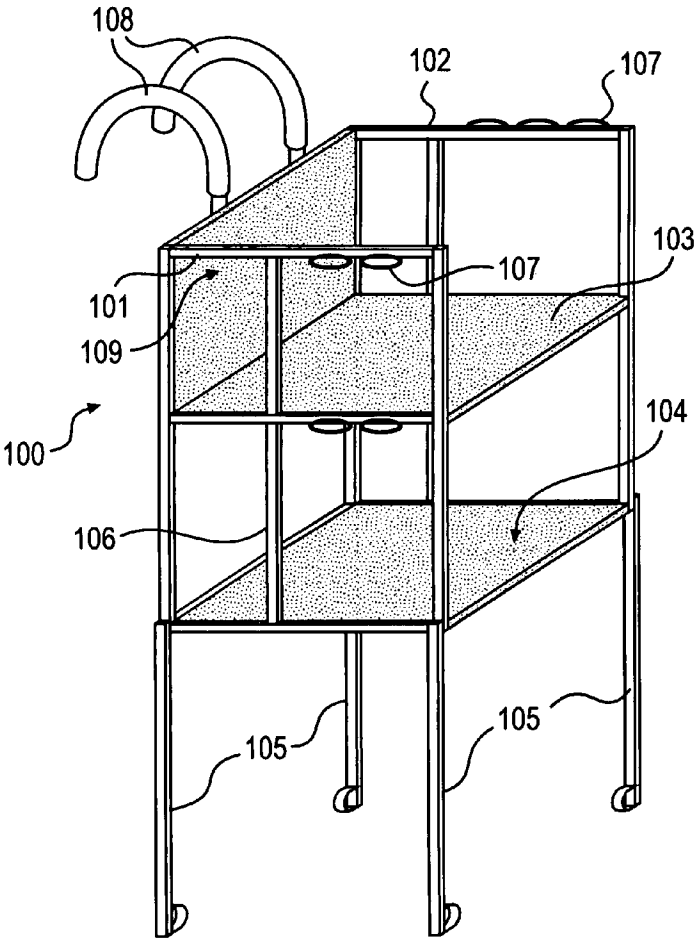
FIG. 1 shows an embodiment of the invention in its open position.

FIG. 1 shows an embodiment of the invention 100 in its fully open configuration. In this embodiment, the apparatus is constructed of aluminum or some other lightweight material. The apparatus may also be constructed of plastic, fabric, or some combination of materials. Back part 109 forms the frame for the apparatus. First side part 101 is connected to back part 109 via a hinge in this embodiment. The hinge connection allows first side part 101 to swing from a closed position to its pictured open position. Second side part 102 is connected to back part 109 via a hinge in this embodiment.

The hinge connection allows second side part 102 to swing from a closed position to its pictured open position. Seat 103 is connected to back part 109 via a hinge in this embodiment. Seat 103 may advantageously be constructed of fabric in order to provide a more comfortable support. Alternatively, a rigid seat 103 may be covered, with a cushion. The hinge connection on seat 103 allows the seat 103 to swing from a closed position to its pictured open position. Shelf 104 is connected to back part 109 via a hinge in this embodiment. The hinge connection allows the shelf 104 to swing from a closed position to its pictured open position. Legs 105 are connected via a hinge to one or more of first side part 101, second side part 102, and back part 109. The hinge connections allow legs 105 to swing from a closed position to the pictured open position. In the pictured open position, legs 105 support the apparatus. In this position, shelf 104 functions to hold supplies. Carrying supports 108 swing from a closed position to the pictured open position. Carrying supports 108 may be cushioned in order to more comfortably sit on a person's shoulders. Carrying supports 108 may alternatively be a flexible material to form a strap. This could include a pair of straps connected to at least one of the back part, the first and second side parts, or a combination of these parts. Also, a single, diagonal strap may function as a carrying support 108.

Figure 2:
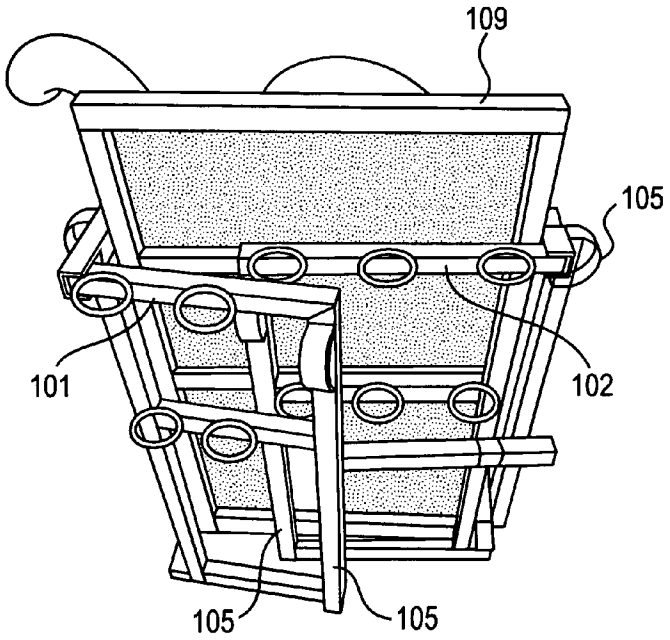
FIG. 2 shows an embodiment of the invention in its closed position.

FIG. 2 shows and embodiment of the apparatus in its fully closed position. A person may carry the apparatus in this position if no supplies are needed. Seat 103 and shelf 104 fold up to rest partially against back part 109. Second side part 102 folds inward to rest partially against seat 103 and shelf 104. First side part 101 folds inward to partially rest against second side part 102. The folded parts may be held in place by any means know in the art such as friction, tension, or a fastener. This embodiment includes four legs 105: one attached to first side part 101, one connected to second side part 102, and two connected to back part 109. In another embodiment, two legs 105 are connected to said first side part 101 and two legs are connected to said second side part 102. It should be recognized that although the embodiment shown includes four legs 105, any number of legs that can support the apparatus would suffice. Further, the legs could extend in other manners, such as telescopically. A single leg in the center of shelf part 104 extending downward could support the apparatus if driven into the ground or equipped with a plate that contacts the ground and provides enough surface area to prevent the apparatus from toppling in normal conditions.

Figure 3:
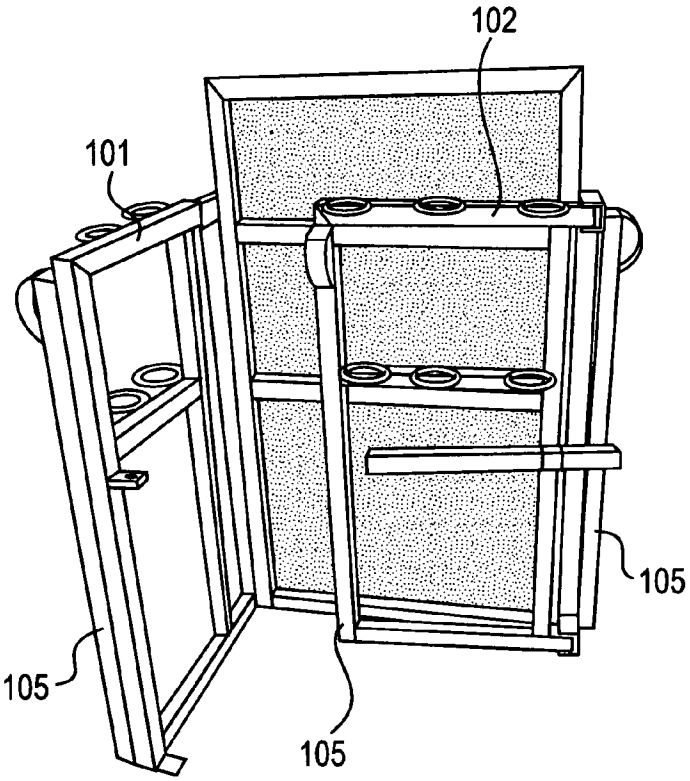
FIG. 3 shows an embodiment of the invention with a first side part in its open position.

FIG. 3 shows an embodiment of the apparatus in the first stage of unfolding from its closed position (shown in FIGS. 2 and 3) to its open position. First side part 101 swings from its closed position (shown in FIGS. 2 and 3) to the open position at approximately a right angle with respect to back part 109. Second side part 102 remains in its closed position.

Figure 4:
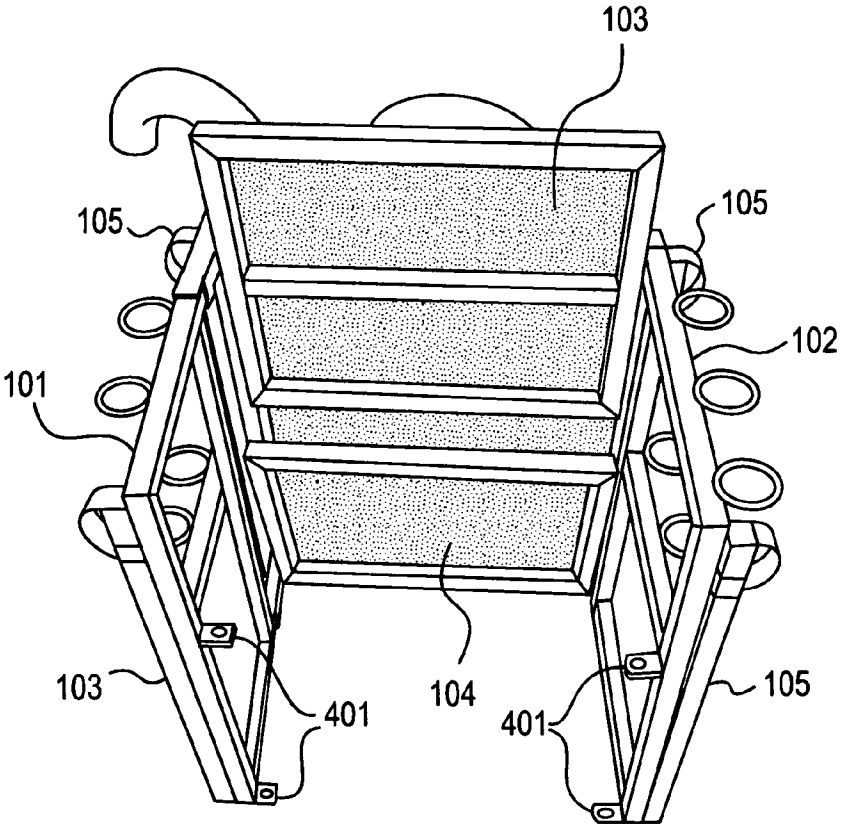
FIG. 4 shows an embodiment of the invention with a second side part in its open position.
Figure 5:
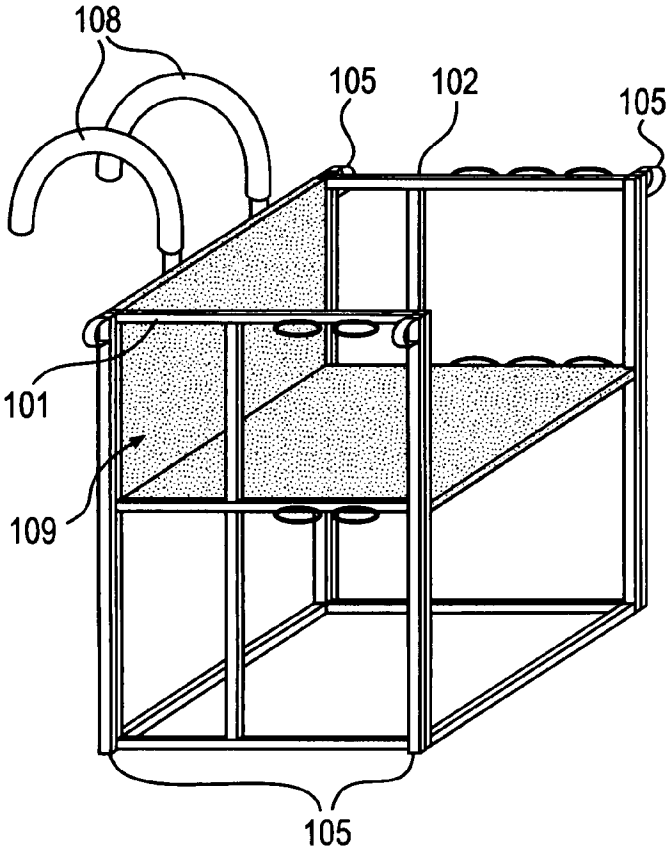
FIG. 5 shows an embodiment of the invention with a seat and shelf in their open positions.

FIG. 4 shows an embodiment of the apparatus in the second stage of unfolding from its closed position (shown in FIG. 2) to its open position. Second side part 102 swings from its closed position (shown in FIG. 2) to its open position at approximately a right angle with respect to back part 109. Seat 103 and shelf 104 remain in their closed positions. When folded down (as shown in FIG. 5), the edges of seat 103 and shelf 104 come into contact with tabs 401. Tabs 401 support seat 103 and shelf 104 to ensure stability. It should be recognized that any means of holding seat 103 and shelf 104 in place would suffice.

FIG. 5 shows an embodiment of the apparatus with all parts open and extended except for legs 105. This is a configuration that may be used for a person to sit on seat 103 while performing an activity, whether recreational or work-related.

When the legs are extended or open, the apparatus is in its open position shown in FIG. 1.

Figure 6:
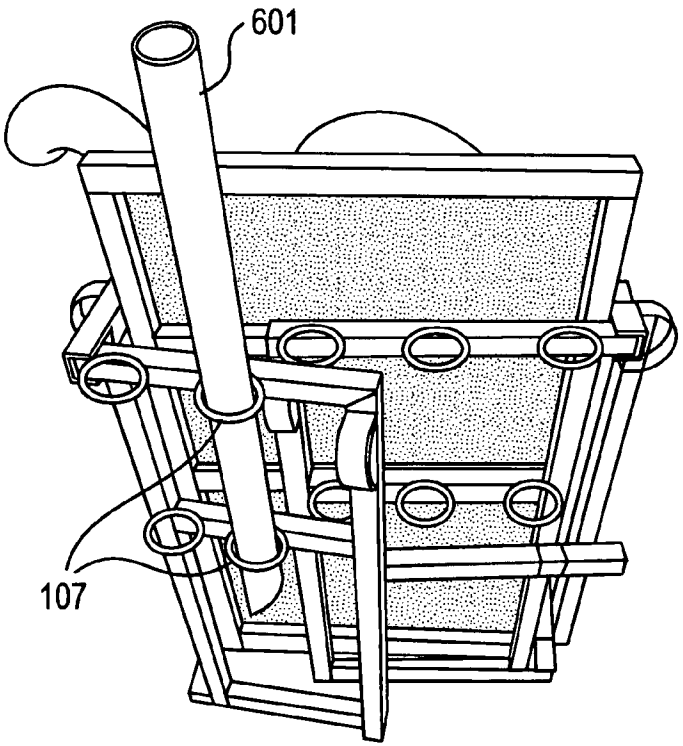
FIG. 6 shows an embodiment of the invention with a retention part in use.

FIG. 6 shows an embodiment of the apparatus in its closed position. This embodiment includes retention parts 107. In this embodiment, the retention parts are a set of rings aligned so that a tube 601 may be inserted. This allows a person to insert an object, such as a fishing rod, into tube 601 and have it held upright. It should be noted that the retention part could be a single part (as opposed to a set). This figure shows five sets of retention parts positioned on first side part 101 and second side part 102. It should be recognized that any number of retention parts could be included and that retention parts may be included on back part 109.

Figure 7:
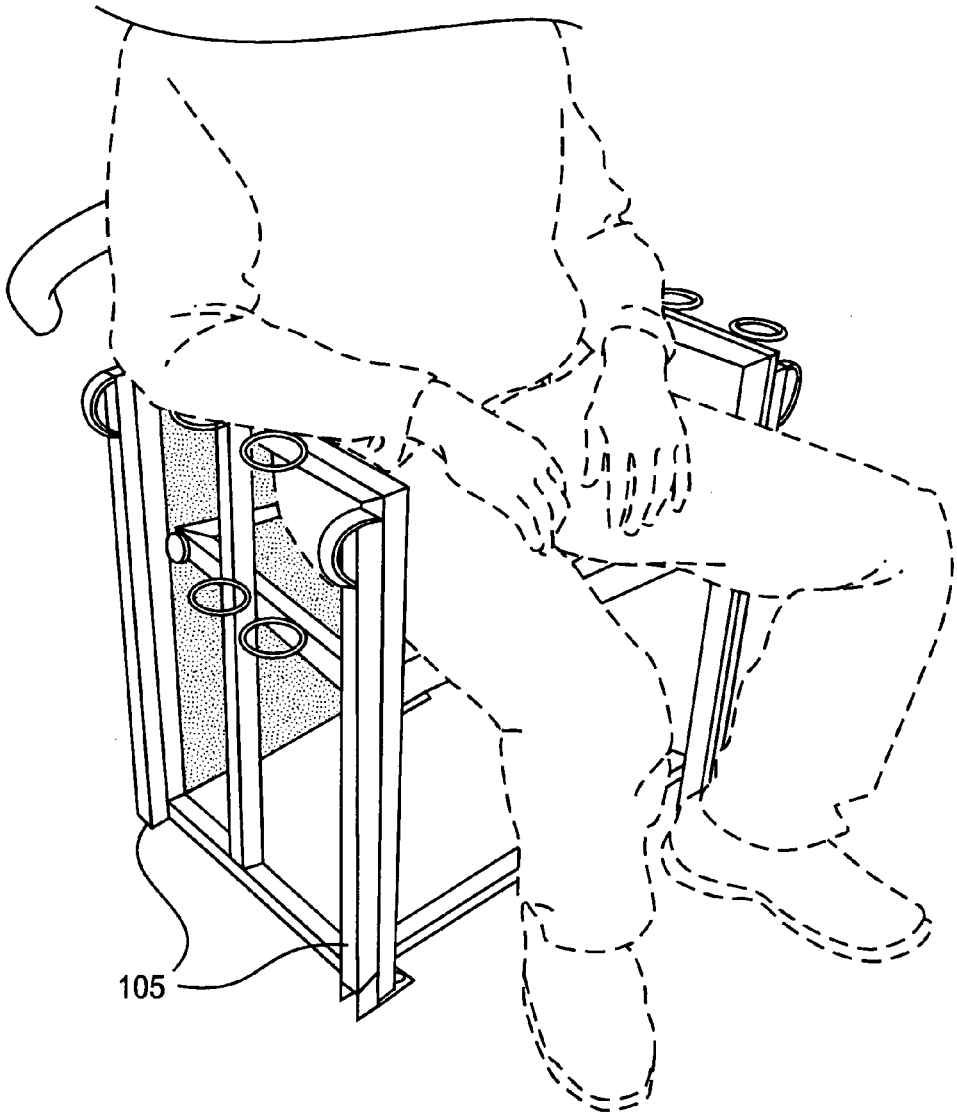
FIG. 7 shows an embodiment of the invention in use as a seat.

FIG. 7 shows an embodiment of the apparatus in a partially open position with a person sitting on seat part 103. This figure also shows legs 105 and optional handles at the end of each leg 105.

Figure 8:
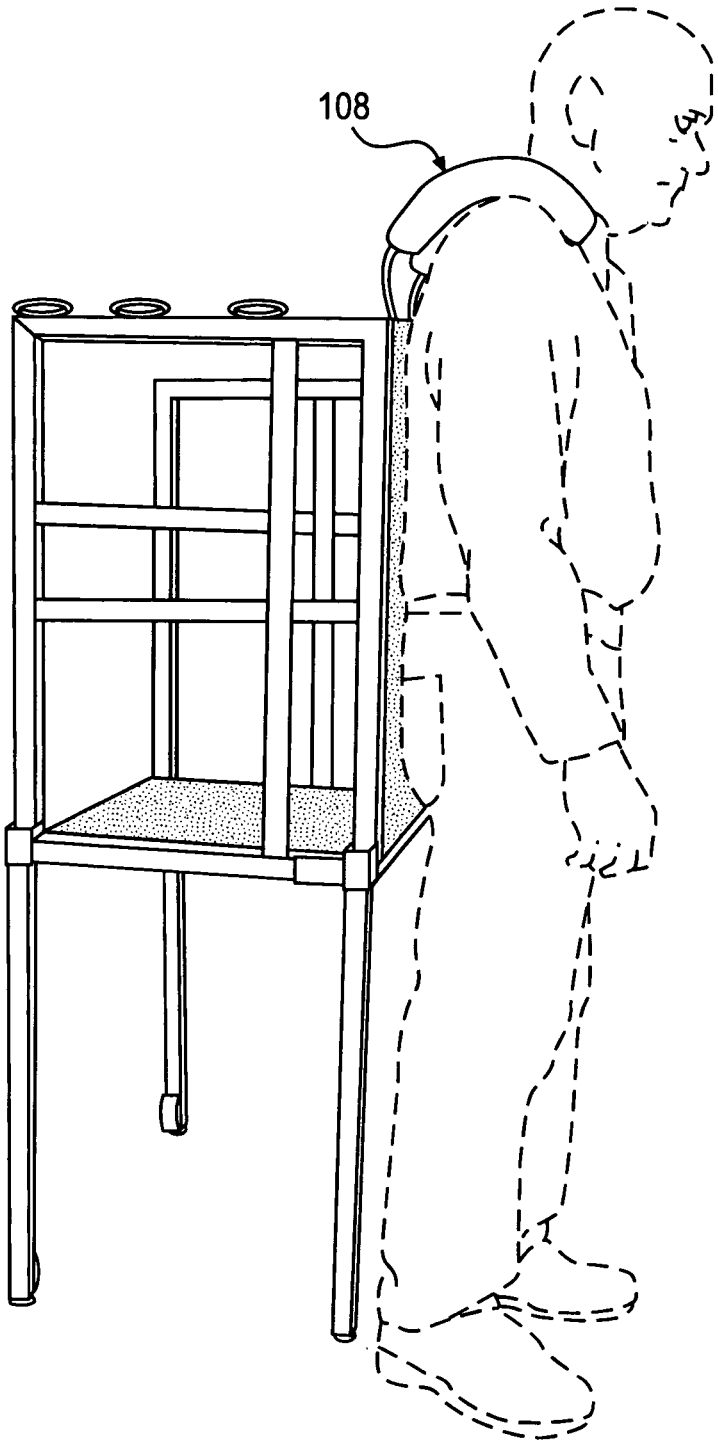
FIG. 8 shows an embodiment of the invention fully opened being carried on shoulders.

FIG. 8 shows an embodiment of the apparatus in its open position. Carrying parts 108 rest on a person's shoulders to allow for portability. This also allows the apparatus to remain upright so a person can store and carry supplies on seat 103 and shelf 104.

The embodiments described and shown in figures are merely illustrative and not intended to limit the scope of the claims.

I claim:

1. An apparatus comprising:

a back part with a first side and a second side wherein said first side and said second side are generally parallel to one another;

a first side part movably coupled to said first side of said back part;

a second side part movable coupled to said second side of said back part;

a seat movably coupled to said back part;

a shelf movably coupled to said back part wherein said shelf is positioned below said seat;

at least one leg part movably coupled to at least one of said back part, said first side part, said second side part, and said shelf;

wherein said first side part, said second side part, said seat, said shelf and said at least one leg move independently from an open position to a closed position;

wherein said at least one leg part comprises a first leg part connected to said first side part;

wherein said at least one leg part further comprises a second leg part connected to said second side part;

wherein said at least one leg part further comprises a third leg part connected to said back part; and wherein said at least one leg part further comprises a fourth leg part connected to said back part;

wherein said first leg part, said second leg part, said third leg part, and said fourth leg part move from a closed position to an open position;

wherein in said open position, said first leg part, said second leg part, said third leg part, and said fourth leg part support the apparatus.

2. The apparatus of claim 1 wherein said at least one leg part is telescopic and extends to an open position to support said apparatus.

3. The apparatus of claim 1, further comprising at least one carrying support connected to at least one of said back part, said first side part, and said second side part.

4. The apparatus of claim 3 wherein said at least one carrying support comprises a carrying support made of flexible material.

5. The apparatus of claim 3 wherein said at least one carrying support comprises a carrying support made of rigid material.

6. The apparatus of claim 1 further comprising at least one retention part attached to one at least of said first side part, said second side part, and said back part, said retention part capable of retaining an object.

7. The apparatus of claim 6 wherein said retention part comprises two rings attached to one of said first side part and said second side part.

* * * * *